United States Patent [19]

Sparr, Sr.

[11] 4,134,697

[45] Jan. 16, 1979

[54] GRAVITY FEED, FOUNTAIN-TYPE CAR BRUSH

[76] Inventor: Anders V. Sparr, Sr., Rte. 1, Box 272, Milligan Rd., Waupun, Wis. 53963

[21] Appl. No.: 794,305

[22] Filed: May 5, 1977

[51] Int. Cl.[2] ..... A46B 11/04

[52] U.S. Cl. ..... 401/276; 222/481.5; 401/286; 401/289; 401/120

[58] Field of Search ..... 401/268–291, 401/120; 222/478, 481.5

[56] References Cited

U.S. PATENT DOCUMENTS

| | | | |
|---|---|---|---|
| 283,692 | 8/1883 | Ballard | 222/481.5 |
| 553,389 | 1/1896 | Brower | 222/525 |
| 1,163,319 | 12/1915 | Campbell | 401/291 |
| 1,904,041 | 4/1933 | Evans | 401/278 |
| 2,041,173 | 5/1936 | Fairchild | 401/278 |
| 2,865,038 | 12/1958 | Versteeg | 401/289 |
| 2,923,293 | 2/1960 | Nawoj et al. | 222/481.5 |
| 2,986,310 | 5/1961 | Spaulding | 222/481.5 |
| 3,211,330 | 10/1965 | Frankel | 222/481.5 |
| 3,369,718 | 2/1968 | Libit et al. | 222/481.5 |

FOREIGN PATENT DOCUMENTS

| | | | |
|---|---|---|---|
| 245041 | 6/1947 | Switzerland | 222/481.5 |

*Primary Examiner*—Clyde I. Coughenour
*Attorney, Agent, or Firm*—Clarence A. O'Brien; Harvey B. Jacobson

[57] ABSTRACT

The invention comprises a brush and cleaning solution storage reservoir for washing of cars, and the like. The storage reservoir has a supply tube extending to the brush to conduct the cleaning solution thereto for use. The supply of cleaning solution to the brush is controlled by selective closure of a vent tube formed in the reservoir of cleaning solution.

5 Claims, 5 Drawing Figures

Fig. 1
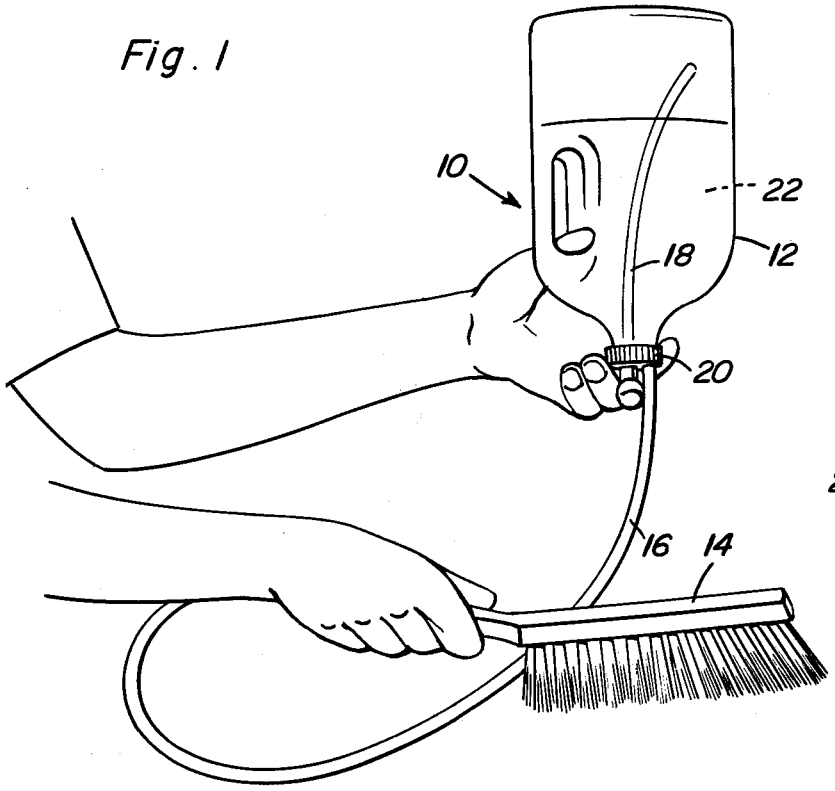
Fig. 3
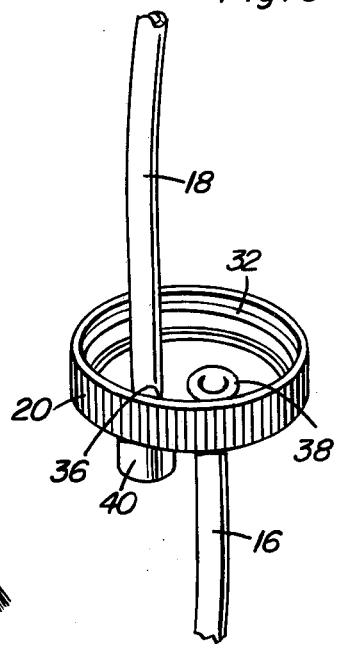
Fig. 4
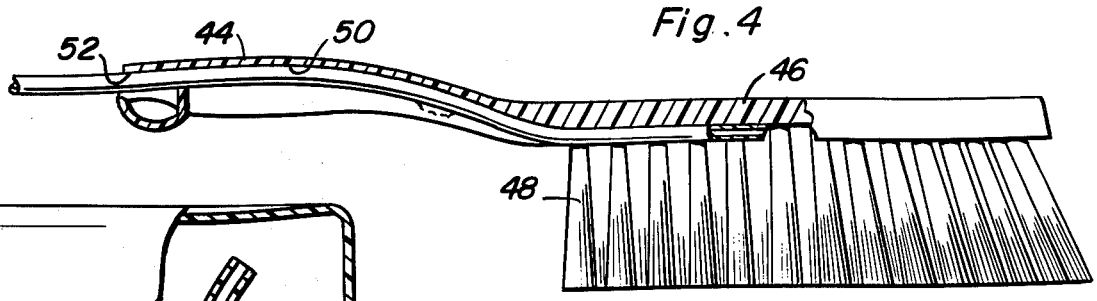
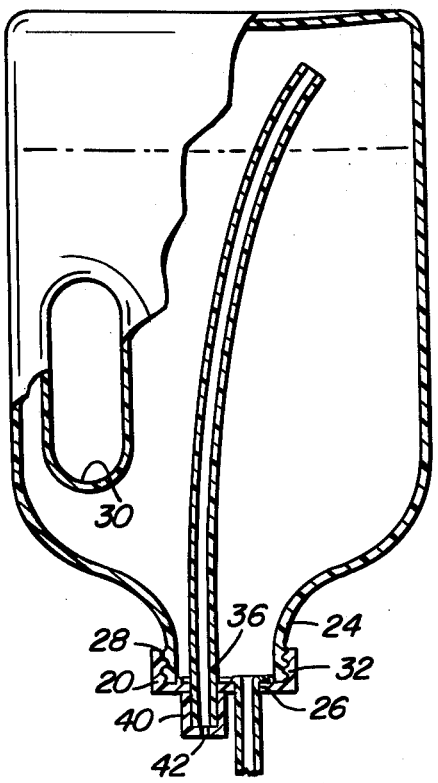
Fig. 2
Fig. 5
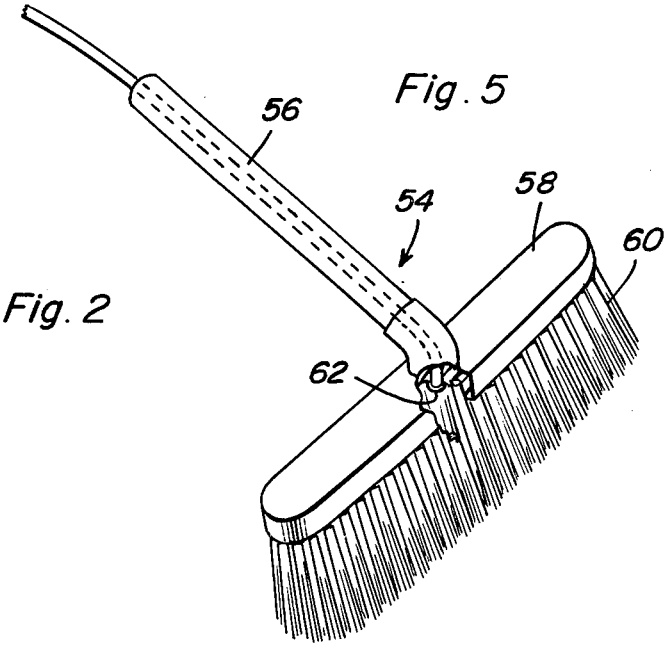

GRAVITY FEED, FOUNTAIN-TYPE CAR BRUSH

BACKGROUND AND SUMMARY OF THE INVENTION

Examples of brush apparatus having a conduit-type connection with a liquid-containing reservoir have previously been suggested in the art. Campbell, in U.S. Pat. No. 1,163,319, discloses such a fountain brush used with an elevated reservoir. Stilling, in U.S. Pat. No. 1,112,168, discloses an irrigating system which utilizes a vent tube and a shut-off valve to control the flow of fluid. The present invention provides inexpensive, simplified apparatus wherein the flow of cleaning solution from a reservoir is controlled by selective closure, such as with a finger, of a vent tube. Flow of solution from the reservoir is caused by gravitational force, the solution remaining in the reservoir on closure of the vent tube as a result of the counteracting force caused by low pressure within an upper portion of the reservoir.

Prior U.S. patents which may be pertinent to the invention includes:

Campbell 1,163,319—Dec. 7, 1915
Stilling 1,112,168—Sept. 29, 1914
Cooper 753,125—Feb. 23, 1904
Sullins 2,663,890—Dec. 29, 1953
Bieganowski 3,284,838—Nov. 15, 1966.

These patents do not disclose the structure of the present invention which allows a user thereof to control flow of a cleaning solution from a reservoir to a brush by simple finger manipulation of an external opening of a vent tube disposed in the reservoir.

The present structure comprises apparatus which can be used with standard liquid containers having narrow outlets, such as the plastic half-gallon milk containers available commercially. The invention provides a cap having threads which allow the cap to be secured to the threaded outlet of the liquid container, the cap having a first aperture formed therein for receiving a flexible gravity-flow tube, the tube extending to remote connection with a brush. A second aperture formed in the cap receives a vent tube therein, the vent tube extending into the interior of the liquid container and having a minor segment thereof extending outwardly of the cap. The outer segment of the vent tube has a cap portion disposed thereon, the cap portion having an aperture formed in the end wall thereof which is small in diameter relative to the internal diameter of the vent tube. When the present apparatus is in use, the user can hold the liquid container and simultaneously open and close the aperture in the cap portion on the vent tube with the use of only one finger, thereby controlling the flow of liquid from the container to the brush.

Accordingly, it is an object of the invention to provide a portable fountain brush for particular use in the cleaning of an automobile, and the like, which enables the user to control the flow of a cleaning solution from a reservoir to the brush.

It is another object of the invention to provide a fountain brush wherein the flow of cleaning solution to the brush is controlled by finger manipulation of a vent tube extending into the reservoir.

It is a further object of the invention to provide a finger manipulable apparatus for controlling the flow of a liquid from a container, such as standard narrow necked half-gallon containers, the apparatus comprising a cap having a vent tube and gravity flow tube disposed therein for attachment to the outlet of the container.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the present invention in an operational environment;

FIG. 2 is an elevational view in partial section of the liquid storage reservoir and associated structure;

FIG. 3 is a perspective view of the cap which attaches onto the outlet of the liquid storage reservoir and the structure mounted on the cap;

FIG. 4 is an elevational view in partial section of one embodiment of a fountain brush; and, FIG. 5 is a perspective view in partial section of a second embodiment of a fountain brush according to the invention.

DESCRIPTION OF THE PREFERRED EMBODIMENTS

Referring now to the drawings and particularly to FIG. 1, the present apparatus is seen at 10 to comprise a liquid storage reservoir container 12, a fountain brush 14, a flexible liquid supply tube 16, a vent tube 18, and a cylindrical cap 20 which connects to the container 12 and carries the supply tube 16 and vent tube 18. As seen in FIG. 1, a user of the apparatus 10 can work the brush 14 with one hand while holding the container 12 in the other hand. As will be further described hereinafter, the vent tube 18 can be closed by the placement of a finger of the hand holding the container 12 over the exterior opening of the tube 18 to prevent flow of cleaning solution or other liquid 22 from the container 12.

The container 12 is seen particularly in FIG. 2 to comprise a standard liquid storage container such as is commonly provided for containment of milk, or other liquids, purchased commercially. The container 12 preferably has a narrow neck 24 which defines an essentially circular opening 26 in the container 12, the neck 24 having threads 28 formed peripherally about the exterior surface thereof as is known and practiced in the art. The container 12 can also conveniently have a handle 30 formed therein in a well-known fashion. The threads 28 on the neck 24 of the container are adapted in a known fashion to receive and secure the cap 20 thereonto to close the opening 26, the cap 20 having mating threads 32 formed in inner wall portions thereof is also seen in FIG. 3, and which cooperate with the threads 28 to removably secure said cap to said container. The cap 20 has two apertures 34 and 36 formed in the upper planar portion thereof, the aperture 34 receiving and securing one end of the supply tube 16 therein and the aperture 36 receiving the vent tube 18 therethrough. The supply tube 16 carries the cleaning solution 22 to the brush 14 when the container 12 is inverted as seen in FIGS. 1 and 2 and when manipulation of the vent tube 18 allows air to be displaced into the upper portion of the container 12.

The supply tube 16 can conveniently be formed with an annular flange 38 about the periphery of the end thereof which extends into the aperture 34, the flange 38 preventing the supply tube 16 from separating from the cap 20. The tube 16 is preferably dimensioned to flushly fit within the aperture 34. Sealing means (not shown) can also be provided between the walls defining the aperture 34 and the exterior surfaces of the supply tube 16 immediately below the flange 38. The vent tube 18 is similarly disposed within the aperture 36, one end of the tube 18 extending outwardly of the cap 20 and having a cylindrical vent cap 40 disposed thereon. The vent cap 40 has an aperture 42 which is of a diameter less than the internal diameter of the vent tube 18 to facilitate closure of the longitudinal lumen defined by the vent tube 18. When the container 12 is inverted as shown in FIGS. 1 and 2, air passes through the aperture 42 in the vent cap 40 and thus through the vent tube 18 into the upper portion of the container. The cleaning solution 22 is thereby allowed to flow through the supply tube 16 to the brush 14. Placement of a finger over the aperture 42 in the vent cap 40 prevents flow of the solution 22 through the supply tube 16. Thus, the flow of the solution 22 can be controlled by simple finger manipulation of the aperture 42 communicating the interior of the container 12 with ambient.

FIGS. 4 and 5 illustrate preferred embodiments of the brush portion of the apparatus, the brush 14 of FIG. 4 comprising a handle member 44 and body member 46 having bristles 48 attached thereto, the handle member 44 having an open-sided recess 50 formed longitudinally thereof to receive the distal end of the supply tube 16 therein. The supply tube 16 terminates at a desired location within the bristles 48, the solution 22 moving into contact with the bristles 48 for replenishment of the solution onto a surface which is to be cleaned. The handle member 44 can burther be formed with an aperture 52 in the free end thereof for receiving the supply tube 16 into the recess 50. FIG. 5 shows a brush 54 having a cylindrical handle member 56 which connects to normally arranged body member 58, the supply tube 16 terminating in proximity to the bristles 60 and functioning to supply the solution 22 thereto.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In combination with a fountain brush and a reservoir container of cleaning solution, an improved flow control apparatus, the improvement comprising:

cap means secured to the reservoir container over an opening disposed therein, said cap means having at least a first and a second aperture formed therein;

a supply tube received in the first aperture, the supply tube extending from the container and connecting with the fountain brush to channel cleaning solution from the container to the brush;

a vent tube received in the second aperture, a first end of the vent tube extending through the second aperture in the cap means into the interior of the container and being of a length at least substantially equal to the depth of the container, a second end of the vent tube extending outwardly of the cap means, a channel extending through the vent tube and communicating the interior of the container to ambient being closeable by simple placement of a finger, or the like, over the second end of the vent tube when the opening in the container is disposed downwardly, the end of the vent tube being disposed above the surface of the cleaning solution when said container is disposed downwardly; handle means formed in the reservoir container, the handle means comprising an opening formed in the body of the reservoir container, the opening being adapted to be grasped by the hand of a user, at least one finger of the hand grasping the container being free to be placed over the second end of the vent tube.

2. The apparatus of claim 1 wherein the reservoir container has a neck portion surrounding and defining the opening, thread means being formed about the periphery of the neck portion, and wherein the cap means comprise a cylindrical body member open at one end, the inner side walls of the body member having thread means formed thereon which mate with the thread means on the container.

3. The apparatus of claim 1, wherein the end of the supply tube disposed interiorly of the reservoir container has an annular flange disposed about the periphery thereof to prevent displacement of said end from the first aperture.

4. The apparatus of claim 1 and further comprising a cylindrical vent cap disposed over the second end of the vent tube and fitting flushly thereover, the vent cap having an aperture formed in a closed outer end thereof which is small relative to the opening in the vent tube.

5. The apparatus of claim 1 and further comprising handle means disposed on the fountain brush, the handle means having a recessed channel formed longitudinally therealong to receive at least a portion of the outer end of the supply tube for mounting therewithin.

* * * * *